US006587398B1

(12) United States Patent
Mock et al.

(10) Patent No.: US 6,587,398 B1
(45) Date of Patent: Jul. 1, 2003

(54) METHOD AND APPARATUS FOR PROVIDING SELECTABLE ROAMING AND NON-ROAMING ALARMS

(75) Inventors: Von Alan Mock, Boynton Beach, FL (US); Eric Thomas Eaton, Lake Worth, FL (US); David Hayes, Lake Worth, FL (US)

(73) Assignee: Motorola Inc., Schaumburg, IL (US)

( * ) Notice: Subject to any disclaimer, the term of this patent is extended or adjusted under 35 U.S.C. 154(b) by 0 days.

(21) Appl. No.: 09/637,763

(22) Filed: Aug. 11, 2000

(51) Int. Cl.[7] ..... G04C 21/00

(52) U.S. Cl. ..... 368/21; 368/47; 368/244; 368/250

(58) Field of Search ..... 368/47, 71, 72, 368/243, 21, 244, 250; 455/575; 340/309.15, 573.1

(56) References Cited

U.S. PATENT DOCUMENTS 4,204,398 A * 5/1980 Lemelson ..... 368/21
4,373,821 A * 2/1983 Morishige ..... 368/21
5,008,866 A * 4/1991 Thinesen ..... 368/21
5,907,523 A * 5/1999 Richins ..... 368/21
6,158,884 A * 12/2000 Lebby et al. ..... 368/47
6,496,116 B2 * 12/2002 Farringdon et al. ..... 340/573.1

* cited by examiner

*Primary Examiner*—David Martin
*Assistant Examiner*—Jeanne-Marguerite Goodwin
(74) *Attorney, Agent, or Firm*—Randi L. Dulaney

(57) ABSTRACT

A communication device such as pager (100) includes a real-time clock circuit (118). The real-time clock circuit keeps track of both the pager's home time zone information (402) and the pager's current time zone information (404). While the pager user is operating within his home area, the pager's home time zone information (402) and the current or local time zone information (404) will be the same. If the user however travels away from his home system's time zone, the real-time clock circuit adjusts the current time zone information (404) to reflect the time zone the user is currently operating in. The user can set alarms which reference either the home time zone information (402) or the current time zone information (404). This allows for more user flexibility on how the alarm conditions are to operate.

14 Claims, 3 Drawing Sheets

100

METHOD AND APPARATUS FOR PROVIDING SELECTABLE ROAMING AND NON-ROAMING ALARMS

FIELD OF THE INVENTION

This invention relates in general to communication systems and devices and in particular to communication devices having a time of day clock.

BACKGROUND OF THE INVENTION

A pager user who is subscribed to a paging system operator which provides for roaming services can use his/her pager when traveling between different cities, and in some cases, between different states or countries. Such roaming capability allows the pager user to receive messages when traveling between distant locations.

Some currently available pagers provide the user with many features including a time of day clock feature. The time of day (also referred to as real time clock information) and sometimes date information is typically displayed on the pager's display when the pager is turned on. Some pagers also provide for other features such as alarm features which let the pager user set the pager so that an alarm is generated at a certain time and date. At the selected time, the pager will typically either emit an audible alert or vibrate, depending on how the pager's alert mode is set by the user. It is known in the art to automatically adjust the pager's time of day clock when a roaming pager enters a new paging system coverage area operating in a different time zone than the pager's home paging system's time zone.

One example of an automatic time zone adjustment to a portable receiver's time of day clock is included within U.S. Pat. No. 5,089,814 to DeLuca et al. assigned to the assignee of the present invention. The automatic time zone adjustment feature automatically adjusts the pager's time of day clock to reflect the local time. This is useful when a pager user roams between different time zones, since the time of day clock is automatically adjusted to reflect the current time of day found in the pager's current system.

Some of the newer paging protocols such as the well known FLEX™ (a trademark of Motorola, Inc.) paging protocol transmit time, date and time zone information as part of the paging protocol which can be used to update the pager's real-time clock information. This information is transmitted to the pager via block information words which are part of the paging protocol and which include local channel ID having time zone information, and real time and date information.

A problem however occurs when a user is roaming between different time zones (between his home time zone and one or more different time zones) and has set an alarm on his pager to alert him/her at a certain time.

A need thus exists for a method and apparatus which can provide effective and reliable alarms.

DESCRIPTION OF THE PREFERRED EMBODIMENT

Figure 1:
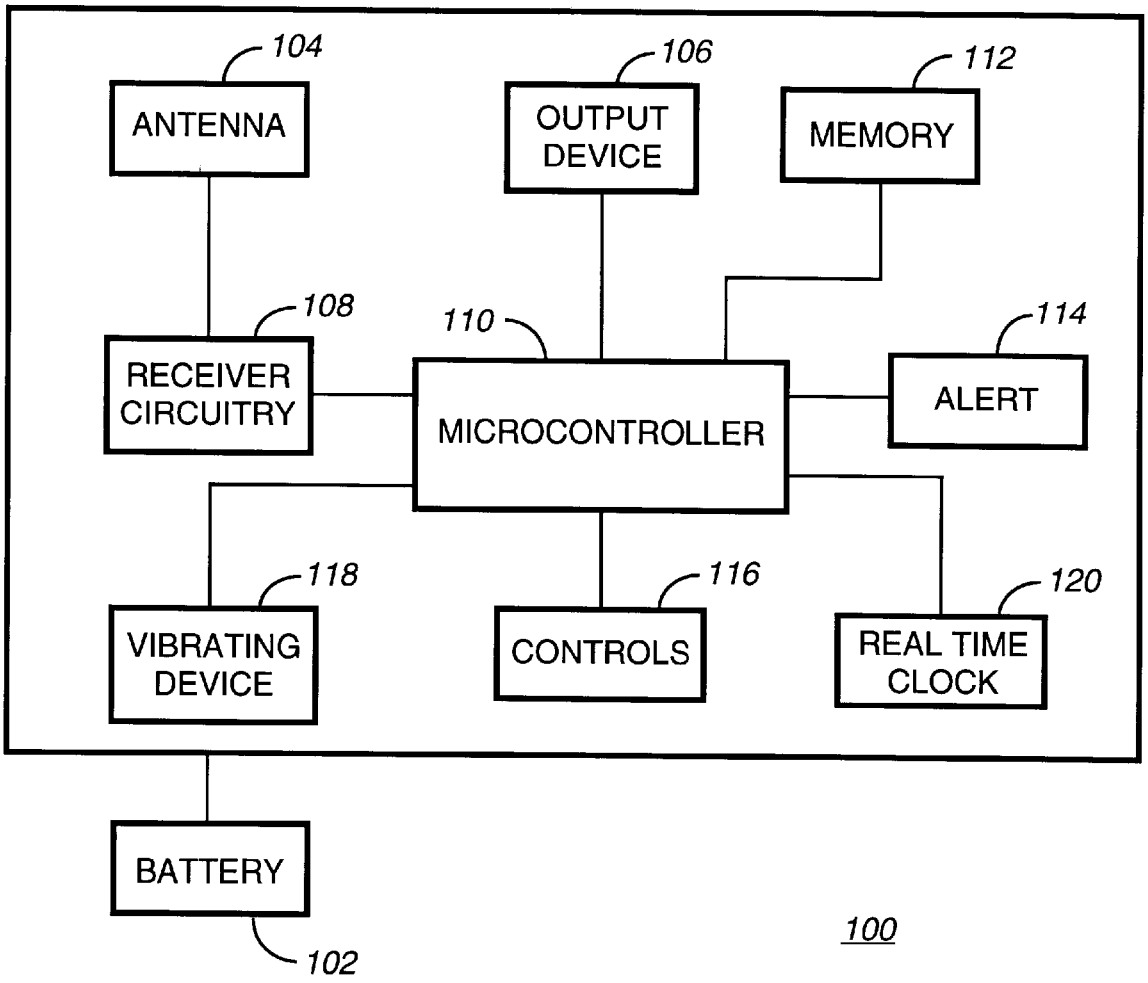
FIG. 1 shows a block diagram of a pager in accordance with the preferred embodiment of the invention.

Referring now to the drawings and in particular to FIG. 1, a simplified block diagram of a selective call receiver 100 such as a pager in accordance with the preferred embodiment of the present invention is shown. Pager 100 includes a primary power supply 102 which can preferably take the form of a nonrechargeable battery, such an alkaline battery, or a rechargeable battery, such as a nickel-cadmium (NiCd) battery. Battery 102 provides power to all of the pager's circuitry. The pager 100 further comprises an antenna 104 that receives a radio frequency (RF) modulated selective call signal and provides the signal to a conventional receiver circuitry 108 for demodulation thereby. A microcontroller or microprocessor 110 processes the demodulated signal to decode an address and optional message data contain therein.

Once recovered, the message data may be stored in the memory or storage area 112 (message buffer) for subsequent presentation by an output device 106, such as a liquid crystal display 106 or an audio transducer 114. In normal operation, the pager's controller 110 compares a decoded address contained in the received signal with a predetermined addresses stored in memory to determine if the message is for that particular pager. The user is alerted by an alert mechanism 114 that a message has been received if the decoded address correlates with one of the predetermined address or addresses. The alert mechanism 114 typically takes the form of an audio transducer, etc. If the pager 100 is set to Silent mode, no audible alert will be given upon receipt of the message. Alternatively, the pager 100 can vibrate instead of sounding an audible alarm upon receipt of an incoming message if equipped with a vibrating device 118. If the received signal contains optional message data, the display 106 will present the message automatically on the display or when manually selected, by user actuated controls 116 which comprise switches, etc.

A real-time clock circuit 120 provides clock and date functions which are displayed on display 106. In accordance with the preferred embodiment of the present invention, pager 100 further includes an alarm feature. The alarm feature allows the user to set alarms which are referenced to either the pager user's home system or the local time. The present invention allows the communication receiver user to specify whether some alarms follow the current or local time zone, while other alarms reference the user's "Home" time zone. The current or local time zone being the time zone associated with the location the pager user is currently operating from, while the home time zone is the time zone associated with the user's typical home or office area.

As an example, in accordance with the invention, a user who's home time zone is in the Eastern Standard Time (E.S.T.) of the United States sets an alarm for 9:00 AM to remind him/her to take medication. If the user travels to California which is in Pacific Standard Time (P.S.T.) passing several time zones along the way, a nationwide paging system provider who provides for automatic time zone time adjustments to the pagers operating in his system will cause the pager's real time clock circuit to become automatically adjusted to the current time zone in California which is P.S.T. However, with the present invention, if the alarm is set with the attribute that the alarm is to reference the home system's time zone (E.S.T.), so the user will be able to take his medication when it is 9:00 AM in his pager's home time zone (E.S.T.), even if his pager's real-time clock has been automatically adjusted to read 6:00 AM P.S.T it will sound the alarm. In this example, pager 100 will keep track of two different time/date information, one for the user's home system (E.S.T.) and one for the current or local time, which in the above example was (P.S.T.).

Alternatively, with the present invention, a user can set his alarm(s) with the attribute that it will reference the current or local time. As an example, a user right before leaving for Japan and while in his home time zone (e.g., E.S.T. in the United States) has set up a meeting with an associate in Japan that will occur the morning he arrives in Japan. The user in this situation in accordance with the invention, sets the pager's alarm attribute to where the alarm will be referenced to the current time zone the pager is operating in. Although during the time the user is setting the alarm condition the home and current time zones are the same since the pager is in its home area, the pager's real time clock 120 will be adjusted automatically once the pager user arrives in Japan, assuming that the paging service provider provides support for roaming between the United States and Japan, and also provides real time clock adjustments as part of the paging protocol.

Figure 2:
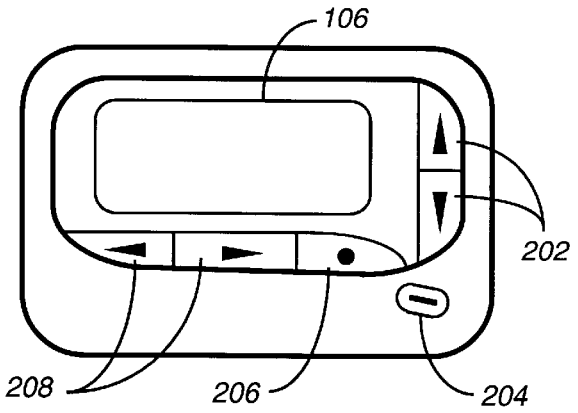
FIG. 2 shows a front view of a pager showing the pager's display and controls in accordance with the preferred embodiment of the invention.

In FIG. 2, a front view of pager 100 in accordance with the invention is shown. In the particular pager shown, the user controls 116 include left/right directional buttons 208, up/down directional buttons 202, a read/reset/power on button 204, and a function/select button. The user controls 116 allows the pager user to set all of the pager's user selectable features and functions, and allows the user to review and delete the messages which have been received. Furthermore, the user controls allows the user to set the real time clock and alarm features mentioned above.

Figure 3:
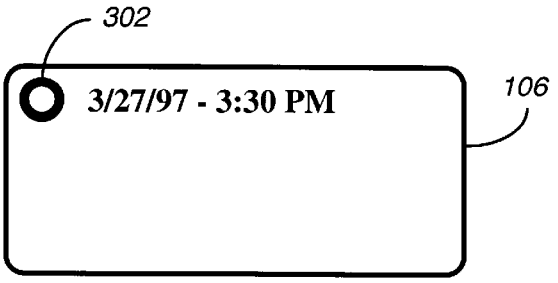
FIG. 3 shows a standby screen pager display in accordance with the present invention.

Referring now to FIG. 3, a standard standby display for pager 100 is highlighted. LCD display screen 106 in the standard standby mode displays the time and date of the current time zone and a "power on" icon 302. As mentioned above, the displayed time and date can be automatically adjusted as the user travels from time zone to time zone. However, in accordance with the invention, the user's "Home" time and date information is also kept stored in the real-time clock circuit 118. In the preferred embodiment, the local or current time zone information is the default time and date information which is displayed on display 106.

Figure 4:
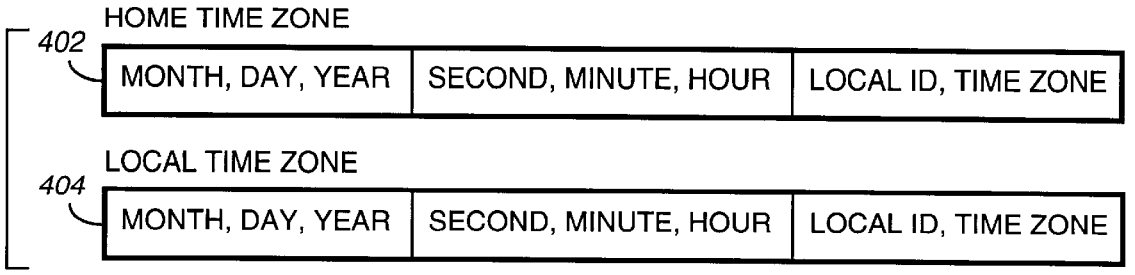
FIG. 4 shows the home time zone and the local time zone information which is stored in the pager in accordance with the preferred embodiment.

FIG. 4 shows.the information which the real-time clock circuit 120 keeps updated in the preferred embodiment for both the home system's real time clock time zone information 402, as well as the current or local time zone's real time clock information 404. This information is preferably stored in volatile memory such as random access memory (RAM) 112 or can be RAM located "on-chip" to controller 110.

As mentioned previously, the current or local time zone information 404 is the time zone in which the pager user is currently operating in, while the home system's time zone information 402 is the location in which the pager user usually operates from. Typically, the home system is where the pager user's home and/or office are located. Preferably, the user can view either of the times by pressing select ones of the user controls 116. Although preferably, by default, the current time zone date and time are shown in the pager's standby screen display 106. If the home and local time zones differ, and the user wants to display the home time zone on display 106, an icon such as "HOME" or "HTZ" can be displayed to the user so that he is aware that the displayed time is that of the home time zone and not the local or current time zone the pager is currently operating in.

The FLEX™ paging protocol as one example of a conventional paging protocol, transmits updated time, date and time zone information as follows to the pagers operating in the paging system: the Hour field is 5 bits long (00000–10111, 1–23), the Minute field is 6 bits (000000–111011, 0–59 minutes), the Seconds field is 3 bits long (000–111, ⅛ minute or 7.5 second increments), the Month field is 4 bits long (0001–1100, January–December), the Day field is 5 bits long (00001–11111, 1–31), and the Year field is 5 bits long (00000–11111, 1994–2025). The time zone information is also sent via a separate block information word which also includes the local channel ID.

In accordance with the invention, the time and date information for both the home or first system and the time and date information for the system in which the pager is currently operating in (or second system) are maintained in pager 100, in memory 112 as previously discussed. Although preferably all of the information shown in home time zone information 402 and local time zone information 404 is updated and stored in pager 100, in other applications, it may be enough just to keep track of a subset of this information. For example, in another embodiment, just the hours, minutes, and day is the only information which is kept updated.

Figure 5:
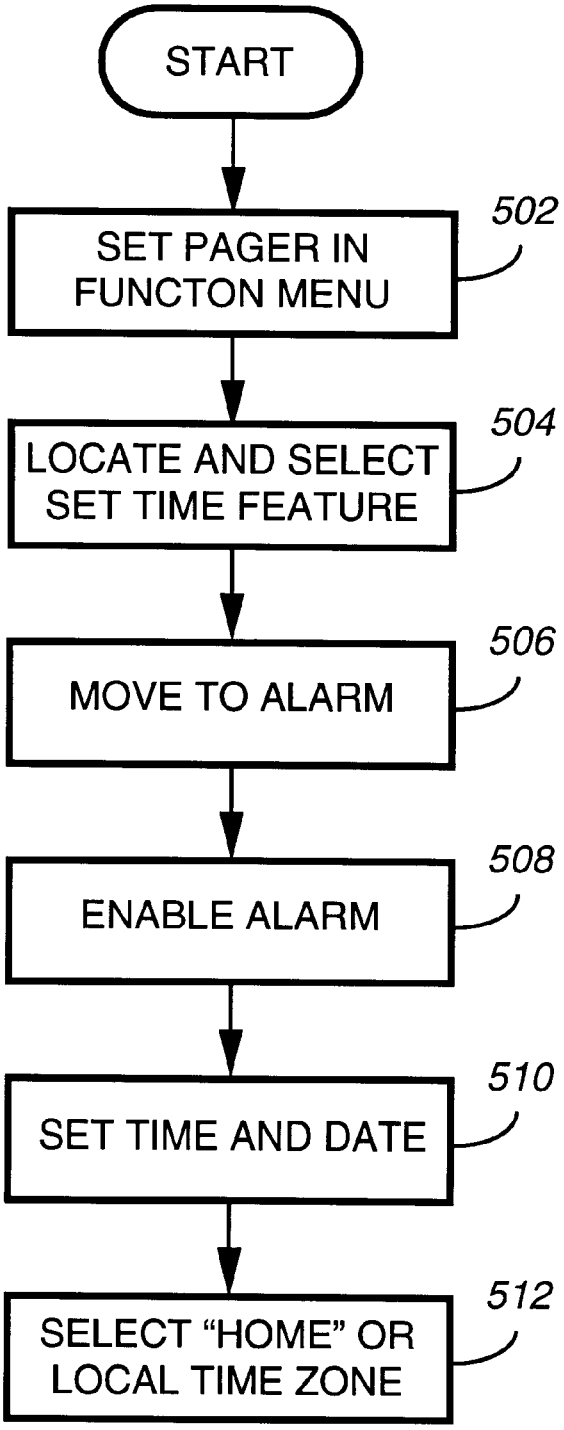
FIG. 5 shows a flowchart which highlights the steps taken to select either the home or local real time clock times as references for the alarm in accordance with the preferred embodiment.

Referring now to FIG. 5, a flowchart which highlights the steps taken in setting a pager's alarm in accordance with the invention is shown. In the preferred embodiment, this procedure tracks closely the "set alarm" procedure for the Motorola ADVISOR® Gold pager FLX™ pager, which is discussed in that pager's user's guide and which is incorporated herein by reference. However, in accordance with the present invention, when the user sets an alarm, the user will also be prompted as to whether the alarm will reference the pager's home system time and date information, or the system in which the pager is or will be operating in which is not the pager's home system.

In step 502, function switch 206 is activated in order to place the pager in the function menu. In step 504, the right/left controls 208 are activated in order to locate the Set Time menu, the Set Time feature is then selected by activating switch 206. In step 506, the up/down arrows 202 are activated in order to move to the Alarm line, followed by activation of the right/left arrow function keys in order to move the cursor to the alarm symbol. In step 508, the alarm is enabled or disabled by pressing up/down keys 202. Once the alarm is enabled in step 508, the alarm time and date are selected by activating the appropriate keys 202, 208 and 206. Finally, once the time and date are set, in step 510, the pager prompts the user as to whether he/she wants the alarm to be referenced from the first or home time zone information 402 or the second or local time zone information 404 in step 512. The pager display 106 may show "HOME" or "LOCAL" as the two available selections, and the user selects between the two selections.

It is worth noting that some possible issues could arise when using the present invention, for example, the same event could cause two or more alarm notifications. This problem could arise when the alarm is triggered and the user crosses two or more time zones backward in time soon thereafter. As an example, the user first receives an alarm in the current time zone and then either gets in a car or flies across several time zones backward in time and is in this new time zone long enough so that the same alarm condition is triggered, causing a repeated alarm. Possible solutions to this conflict is to allow the event to alarm only once during a 12 hour period to keep from triggering an alarm more than once, this can be referred to as a dumb lockout. Variations can be made on the lockout scheme that could take into account the rate of crossing time zones (e.g., rate of change of home time zone to newly acquired time zone information) and realize not to generate an alarm multiple times for the same event.

Another situation may occur where following the home or local time zone may not function as anticipated, or may alarm at a dubious time. For example, the user who's non-roaming (home time zone) alarm occurs every morning at 9:00 AM to remind him/her to take medication may not want to be awaken at 3:00 AM in a new time zone if it happens that the user travels to a new time zone and forgets to change the above alarm to track the current and not home time zone. In this example, several solutions can be found, one of which would allow the user to see upon entering a new time zone, for a period of time, a list of scrupulous non-roaming alarms (e.g., alarms which will be triggered between 12:00 AM and 4:00 AM, etc.) that the user may not want to occur, based on the old time zone. These non-roaming alarms could be shown in display 106 for a predetermined period of time after the user enters the new time zone. This would give the pager user an opportunity to modify any of the scrupulous alarms from triggering off of the home time zone information 402. Another solution would be to have a user programmed lock out period where the non-roaming alarm(s) (those set to reference the home time zone) would not be allowed to be audible, for example between the hours of 12:00 AM and 4:00 AM (local time) if the user travels to another time zone. During this time period range or lock out period, alarms which reference the home time zone would all generate a vibratory alarm using vibrating device 118 until the lock out time period had passed. One can also add a visual alarm during the lock out period which would let the user know of an elapsed alarm(s), without disturbing the user in case the user were sleeping during this lock out time period.

The present invention provides the flexibility of allowing a pager user to set alarms which are referenced to either the pager user's home system time zone, also referred to as a non-roaming alarm, or referenced to the pager's current or local system time zone, referred to as a roaming alarm which can change as the user travels through different time zones. This added flexibility allows the pager user to tailor his/her alarm conditions as best fits the current circumstances. Although the discussion of the preferred embodiment has been with regards to a pager, other communication devices such as cellular radiotelephones, trunked radios, etc., can benefit from the use of the present invention.

While the preferred embodiments of the invention have been illustrated and described, it will be clear that changes, variations, substitutions and equivalents will occur to those skilled in the art without departing from the spirit and scope of the present invention as defined by the appended claims.

What is claimed is:

1. A method for providing selectable roaming and non-roaming alarms for a communication device having a home communication area with a home time zone information, comprising the steps of:

setting an alarm within the communication device;

selecting whether the alarm is to be referenced to the home time zone information or to a local time zone information;

wirelessly receiving a current local time zone information associated with each of a plurality of local communication areas from each of a plurality of local communication systems when the communication device roams into each of the plurality of local communication areas;

updating the local time zone information using the received current local time zone information associated with the current local communication area in which the communication device is located; and triggering the alarm using the time zone information selected for the alarm to be referenced to in the selecting step.

2. A method as recited in claim 1, wherein the communication device stores the home time zone information for the communication device's home communication system and the local time zone information for the current local communication area; and further wherein the communication device automatically updates the local time zone information when the communication device roams into a new local communication area.

3. A method as recited in claim 1, wherein the local time zone information is updated automatically as the communication device moves through different time zones.

4. A method as recited in claim 1, further comprising:

displaying at the communication device the alarm which has been set when the alarm is selected to be referenced to the communication device's home time zone information and the communication device enters a communication area which is in a different time zone than the home communication area.

5. A method as recited in claim 1, wherein the alarm is set to be referenced to the communication device's home time zone information, and further wherein the communication device enters a communication area having a different time zone information than the home time zone information, the method further comprising:

comparing the alarm to a predetermined lock out period; and preventing the alarm from generating an audible alert when the alarm falls within the predetermined lock out period.

6. A method as recited in claim 1, wherein the alarm activates an alert condition once within a predetermined period of time when the communication device operates within two or more different time zones.

7. A method for providing an alarm for a communication device, comprising the steps of:

providing to the communication device a first real time clock information referenced to a first time zone;

wirelessly providing to the communication device a second real time clock information referenced to a second time zone, wherein the communication device is currently operating in the second time zone, and further wherein the second real time clock information is provided from a communication system within the second time zone;

setting an alarm which is referenced to either the first real time clock information or the second real time clock information;

wirelessly providing to the communication device a third real time clock information referenced to a third time zone, wherein the communication device is currently operating in the third time zone, and further wherein the third real time clock information is provided from a new communication system within the third time zone; and updating the reference for the alarm to the third real time clock information when the alarm is set to reference the second real time clock information.

8. A method as recited in claim 7, wherein the communication device has a home communication area with a home time zone information, and further wherein the first real time clock information is the home time zone information.

9. A method as recited in claim 7, wherein the communication device comprises a pager, and further wherein the third real time clock information includes updates received from the new communication system to correct for changes caused by the pager roaming into the third time zone in which the new communication system operates.

10. A method as recited in claim 9, wherein the second real time clock information is updated by the further step of:

transmitting an update message to the pager upon the pager roaming into an operating area which is in a different time zone than the operating area from which the pager departed.

11. A communication device having a home communication area and operable in at least one other communication area located in a different time zone than the home communication area, comprising:

a receiver for wirelessly receiving a current local real time clock information associated with each of a plurality of local communication areas from each of a plurality of local communication systems when the communication device roams into each of the plurality of local communication areas;

a real time clock circuit for maintaining a home real time clock information associated with the home communication area and for maintaining the local real time clock information associated with the at least one other communication area; and a controller coupled to the receiver and coupled to the real time clock circuit, wherein the controller is programmed to:

set an alarm which is referenced to either the home real time clock information associated with the home communication area or the local real time clock information associated with at least one of the plurality of communication areas, update the local real time clock information using the received current local real time clock information associated with the current local communication area in which the communication device is located, and trigger the alarm using the real time clock information in which the alarm is referenced.

12. A communication device as recited in claim 11, wherein the communication device comprises a pager.

13. A communication device as recited in claim 11, wherein the receiver receives one or more real time clock information updates for updating the local real time clock information for the plurality of local communication areas.

14. A communication device as recited in claim 13, wherein the local real time clock information for the plurality of communication area is updated automatically each time the communication device moves between operating areas located in different time zones.

* * * * *